United States Patent [19]

Fukuda et al.

[11] Patent Number: 4,862,692

[45] Date of Patent: Sep. 5, 1989

[54] SUPERCRITICAL PRESSURE ONCE-THROUGH BOILER

[75] Inventors: Seiji Fukuda; Kaneko Shozou; Takuji Fujikawa; Hiroshi Oda; Tadashi Gengo; Kazushi Fukui, all of Nagasaki, Japan

[73] Assignee: Mitsubishi Jukogyo Kabushiki Kaisha, Tokyo, Japan

[21] Appl. No.: 161,128

[22] Filed: Feb. 26, 1988

[30] Foreign Application Priority Data

Mar. 11, 1987 [JP] Japan ..... 62-54183
Apr. 22, 1987 [JP] Japan ..... 62-97625

[51] Int. Cl.[4] ..... F01K 21/00; F22G 5/00; F22D 7/00

[52] U.S. Cl. ..... 60/670; 60/653; 60/667; 60/715; 122/406 S; 122/479 S

[58] Field of Search ..... 60/653, 654, 660, 664, 60/665, 667, 670, 643, 645, 715; 122/406 S, 479 S

[56] References Cited

U.S. PATENT DOCUMENTS

| | | | |
|---|---|---|---|
| 3,259,111 | 7/1966 | Koch | 122/406 S |
| 3,612,005 | 10/1971 | Lytle | 122/406 S |
| 3,908,686 | 9/1975 | Carter et al. | 60/664 |
| 4,487,166 | 12/1984 | Haller et al. | 122/406 S |

*Primary Examiner*—Allen M. Ostrager
*Attorney, Agent, or Firm*—Wenderoth, Lind & Ponack

[57] ABSTRACT

In order to obviate a short life and an expensive maintenance cost of boiler throttle valves as well as plant loss caused by pressure reduction at the boiler throttle valves in a supercritical pressure once-through boiler a supercritical pressure once-through boiler, in which boiler water transformed into steam in boiler furnace wall tubes is further heated in a superheater and is then fed to a main turbine, is improved in that boiler throttle valves and a heat recovery apparatus are provided on the downstream side of the boiler furnace wall tubes.

6 Claims, 7 Drawing Sheets

SUPERCRITICAL PRESSURE ONCE-THROUGH BOILER

BACKGROUND OF THE INVENTION

1. Field of the Invention

The present invention relates to a supercritical pressure once-through boiler in which boiler water transformed into steam in boiler furnace wall tubes is further heated in a superheater and is then to a main turbine.

2. Description of the Prior Art

Constant-pressure type supercritical pressure once-through units have been designed and constructed for use in base load operations, but to promote nuclear power generation and to accommodate for the difference in the demand for power during different seasons or during the date and at night, in the future, a load regulating capability including very frequent stopping and starting during the night will be required for such units, in view of the demand for efficient power systems.

At present, nearly all boilers employed for base load operations are constant-pressure operation boilers in which steam pressure for a load is constant. Whereas a turbine consists of a combination of nozzles and blades that can be deemed to be one closed flow passageway through which fluid flows, if the load on the system is reduced and the flow rate of steam becomes lower, then since the pressure of the steam at the inlet of the turbine is also lowered, in view of the operational relationship of the turbine and the boiler it is necessary to reduce the pressure at the inlet of the turbine. If the pressure of steam at the inlet of the turbine can be lowered, it would be reasonable to lower the pressure of the boiler, too (variable pressure operation), in view of economy.

A main steam system of a once-through boiler in the prior art is generally shown in FIG. 11.

In this figure, water coming from a condenser (not shown) is pressurized by a boiler feed water pump 1 and then heated in a high-pressure feed water heater 2 and an economizer 3. This heated feed water then passes through a boiler furnace wall tube 4, a boiler throttle valve 5, and superheaters 6 8, and thereby being further heated. During this period, the temperature of the heated feed water is regulated to a temperature that is necessary to operate a main turbine (high-pressure turbine) 9 by means of a temperature-reducer 7, and its pressure is regulated by the boiler throttle valve 5 (basically, only for a partial load).

In the above-mentioned principal steam system of a once-through boiler, the water flowing out of the boiler furnace wall tube 4 can be regulated to a pressure that is necessary to operate the main turbine 9 at a load lighter than a predetermined partial load. However, the pressure reduction caused by the choking operation of the boiler throttle valve 5 creates the following problems.

Firstly, since the boiler throttle valve 5 is used continuously under a severe operating condition of a large pressure difference, its life is short, it is necessary to replace the valve periodically, and hence cost associated with the valve is expensive in terms of maintenance.

Also, since the steam is subjected to equienthalpy change in the boiler throttle valve 5 and creates no usable work, a pressure reduction at this portion is in the form of plant loss.

SUMMARY OF THE INVENTION

It is therefore one object of the present invention to provide a novel supercritical pressure once-through boiler which is free from the above-described shortcomings in the prior art.

A more specific object of the present invention is to provide a supercritical pressure once-through boiler in which the short life and the expensive maintenance cost associated with the boiler throttle valve are obviated and also the plant loss caused by pressure reduction at the pressure throttle valve can be eliminated.

According to one feature of the present invention, there is provided a supercritical pressure once-through boiler of the type in which boiler water transformed into steam in boiler furnace wall tubes is further heated in a superheater and is then fed to a main turbine, and in which boiler throttle valves and a heat recovery apparatus are provided on the downstream side of the boiler furnace wall tubes.

According to another feature of the present invention, there is provided the above-described supercritical pressure once-through boiler in which the heat recovery apparatus is a boiler throttle turbine.

According to still another feature of the present invention, there is provided the aforementioned supercritical pressure once-through boiler in which the heat recovery apparatus is disposed between a primary superheater and a final superheater.

According to a further feature of the present invention, there is provided the aforementioned supercritical pressure once-through boiler in which the heat recovery apparatus is disposed between the boiler furnace wall tubes and a primary superheater.

According to the present invention, due to the above-mentioned structure, a reduction in the pressure of the steam can be effected by means of the heat recovery apparatus in lieu of the boiler throttle valves.

More particularly, according to the present invention, since a heat recovery apparatus such as a turbine or the like is provided on the downstream side of the boiler furnace wall tubes and reduction in pressure of the steam can be effected by means of this heat recovery apparatus in lieu of the boiler throttle valves, replacement of the boiler throttle valves is required comparatively infrequently, and hence the boiler throttle valves are less expensive to maintain.

In addition, due to the fact that energy in the form of steam pressure is recovered by the heat recovery apparatus and converted into a different form of energy, plant efficiency is improved as compared with a boiler in which the heat recovery apparatus is not provided (for example, in one preferred embodiment of the invention, in which a boiler throttle turbine and an electric generator are employed in combination as will be described later, the plant efficiency can be enhanced by 0.6%–5.0%).

Moreover, when a boiler throttle turbine is retrofitted in existing boilers as a heat recovery apparatus, such reconstruction is cheaper than variable pressure furnace reconstruction in which the entire furnace is reconstructed, and merits obtained by the present invention are greater than those afforded by the variable pressure furnace.

The above-mentioned and other objects, features and advantages of the present invention will become more apparent by referring to the following description of preferred embodiments of the invention taken in conjunction with the accompanying drawings.

DETAILED DESCRIPTION OF THE PREFERRED EMBODIMENT

Figure 11:
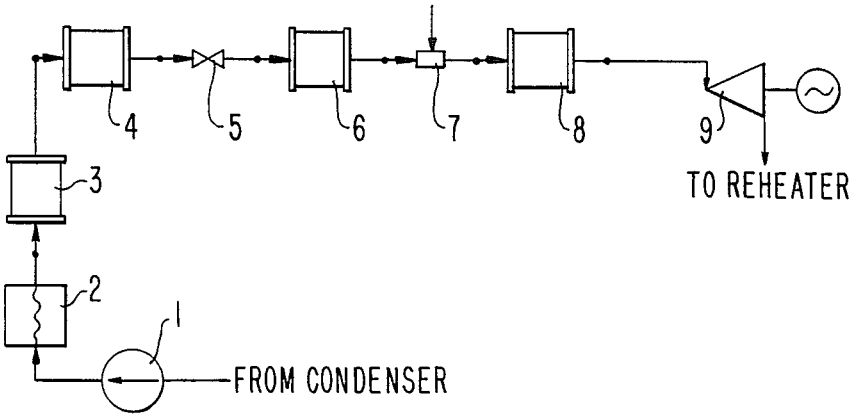
FIG. 11 shows a main steam system in a oncethrough boiler in the prior art.

Now, preferred embodiments of the present invention will be described in detail with reference to FIGS. 1 through 10. It is to be noted that in these figures component parts identical to those shown in FIG. 11 are given like reference numerals and further description thereof will be omitted.

Figure 1:
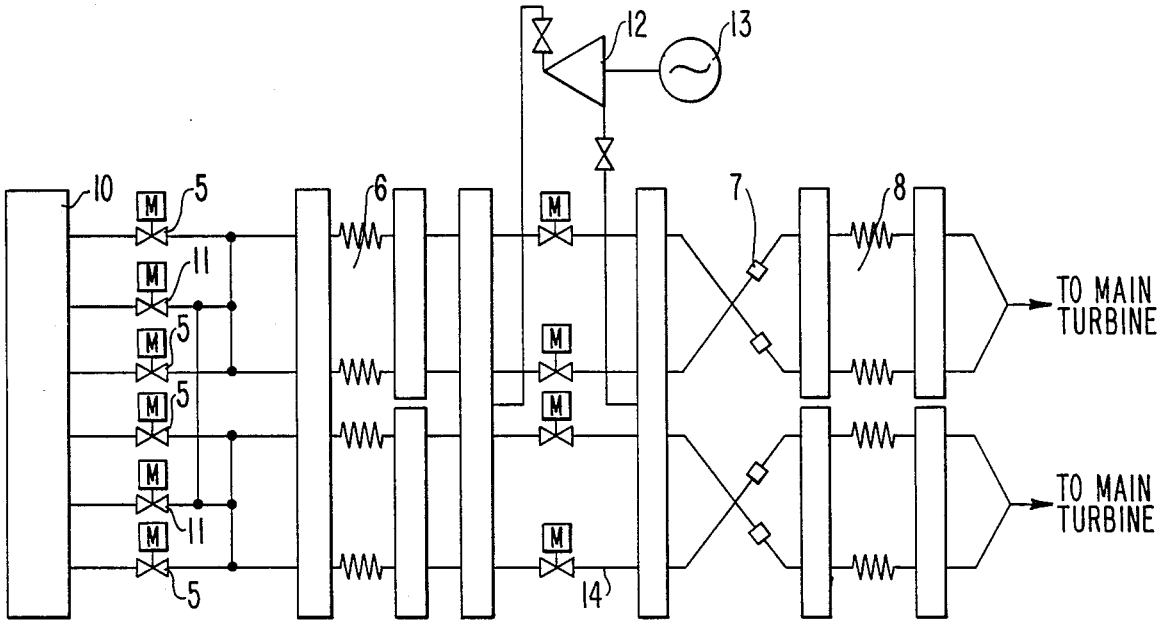
FIGS. 1 and 2 are system diagrams showing two different preferred embodiments of the supercritical pressure once-through boiler according to the present invention.

A first preferred embodiment of the present invention is illustrated in FIG. 1, in which boiler throttle valves 5 are provided on the downstream side of boiler furnace wall tubes and on the upstream side of a primary superheater 6, and a small boiler throttle turbine 12 serving as a heat recovery apparatus is disposed between the primary superheater 6 and a final superheater 8 so that steam passed through this turbine 12 may be fed to the final superheater 8.

More particularly, steam ejected from the boiler furnace wall tubes accumulates in a furnace outlet header 10, is then passed through boiler throttle valves 5 or boiler throttle bypass valves 11, and is heated in the primary superheater 6. Then this superheated steam passes through boiler throttle tubine bypass valves 14 if the boiler throttle turbine 12 has been tripped or when the system is operated under a load in a range corresponding to a mode in which the boiler throttle turbine 12 is not to be used, for instance, under rated loading (100% loading) or under light loading (about 25% loading or less). However, under a load in a range corresponding to a mode in which the boiler throttle turbine 12 is used, for instance, under 24–90% loading (in the case of 90% variable-pressure), the steam passes through the boiler throttle turbine 12, and hence the pressure of the steam is reduced to a pressure necessitated by the main (high-pressure) turbine 9 shown in FIG. 11, and it rotates a generator 13 (or a compressor) to effect generation of electric power (or to pressurize reheated steam). The temperature of this steam having its pressure reduced by the boiler throttle turbine 12 is then regulated by means of a temperature-reducer 7, and thereafter, it is passed through a final superheater 8 and is led to a main turbine.

Figure 2:
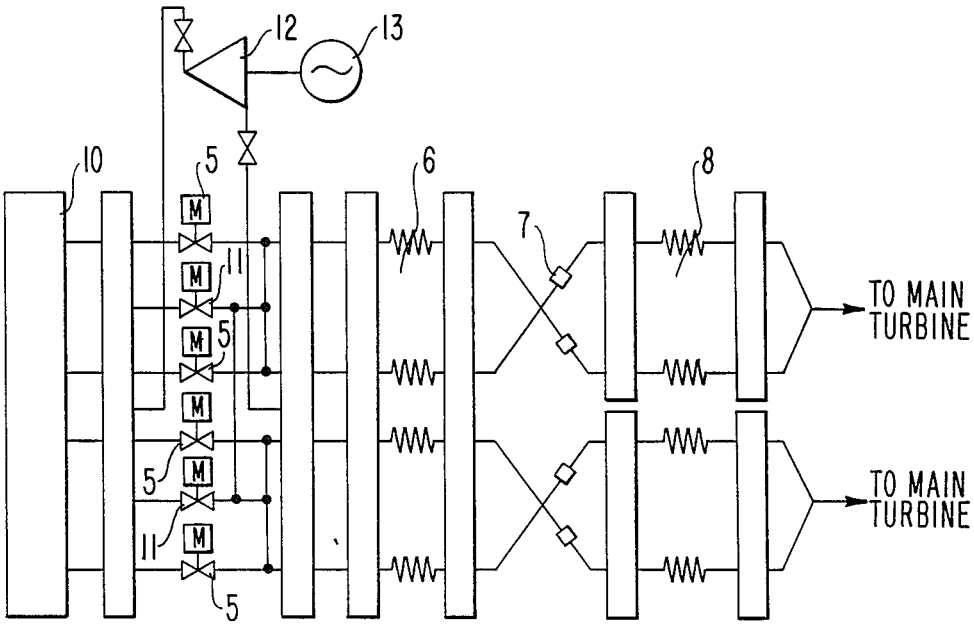

A second preferred embodiment of the present invention is illustrated in FIG. 2, in which the boiler throttle turbine 12 shown in FIG. 1 is disposed in a bypass of boiler throttle valves 5 provided on the downstream side of boiler furnace wall tubes.

More particularly, and similar to the preferred embodiment shown in FIG. 1 in which a boiler throttle turbine is operatively disposed between superheaters, steam ejected from boiler furnace wall tubes is first gathered in a furnace outlet header 10. The pressure of this gathered steam is reduced by the boiler throttle turbine 12 to a pressure necessitated by a main (high-pressure) turbine, and it rotates a generator 13 (or a compressor) to effect generation of electric power (or to pressurize reheated steam). Furthermore, when the boiler throttle turbine 12 has been tripped, or when the system is under a load outside of the range corresponding to a mode in which the boiler throttle turbine 12 is used (under 100% loading or under about 25% loading or less) the steam passes through the boiler throttle valves 5 or boiler throttle by-pass valves 11 and is led to superheaters 6 and 8.

Figure 3:
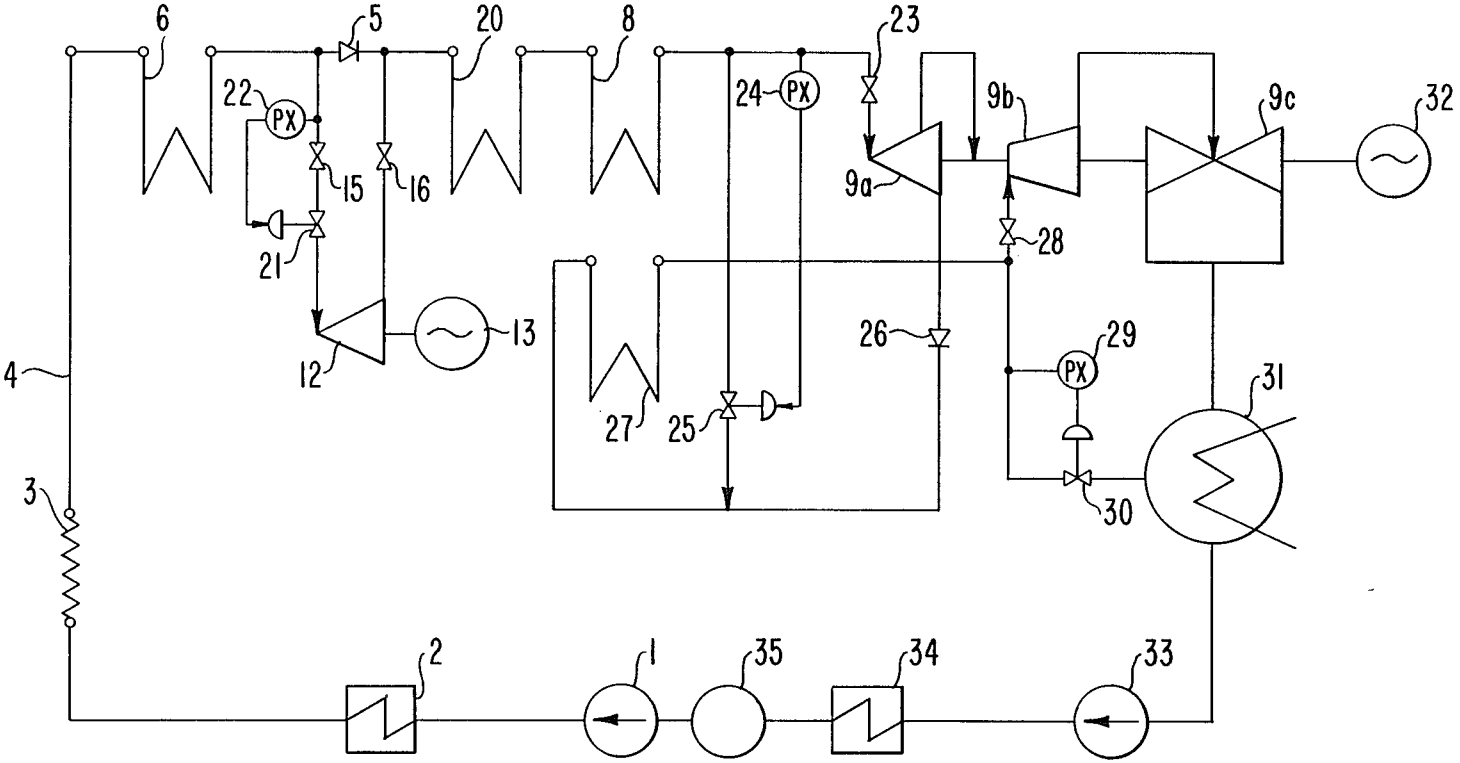
FIG. 3 is a system diagram showing a variablepressure operation plant in which a generator is driven by a boiler throttle turbine according to another preferred embodiment of the present invention.

A third preferred embodiment of the present invention is illustrated in FIG. 3, in which the boiler throttle turbine 12 is disposed between a primary superheater 6 and an auxiliary superheater 20 that is located on the upstream side of a final (secondary) superheater 8, and when the boiler throttle valves 5 and the generator 13 are to be used, the boiler throttle valves 5 are closed, and valves 15 and 16 are opened.

Now, in FIG. 3, the steam superheated while passing through an economizer 3, furnace wall tubes 4 and the primary superheater 6 in the boiler is led to the boiler throttle turbine 12. A steam adjusting valve 21 of this boiler throttle turbine 12 is controlled by a pressure regulator 22 so that steam pressure at the inlet of the boiler throttle turbine may be maintained constant. Thus, the pressure in the furnace wall tubes 4 and the primary superheater 6 can be maintained constant.

The boiler throttle turbine 12 drives the generator 13. Thus, exhaust gas of this boiler throttle turbine 12 is superheated to a further degree while passing through the auxiliary superheater 20 and the final superheater 8, and is then led to a high-pressure turbine 9*a* of a main turbine. The auxiliary superheater 20 is provided for the purpose of compensating for a temperature fall of the steam because the steam ejected from the primary superheater 6 has its temperature lowered due to the work performed on the boiler throttle turbine 12. However, in some cases there is no need to provide this auxiliary superheater 20 depending upon the expected performance of the boiler.

A main turbine system adjusting valve 23 is used for regulating the output of the high-pressure turbine 9*a*. Various methods of controlling the steam adjusting valve 23 for facilitating variable-pressure operation of the system are apparent and are represented by the methods enumerated below, any of which could be practically employed:

1. Steam adjusting valve opening constant method: This is a method in which the boiler is operated with the degree of opening of the steam adjusting valve constant and hence the main turbine output is uniquely determined by the main steam output. According to this method, however, it is difficult to precisely control the main turbine output because, during a transient period when the load varies, the main steam pressure can be hardly controlled in a precise manner.

2. Steam adjusting valve opening fine-adjustment method: This is a method in which the degree to which the steam adjusting valve is open is not perfectly constant as opposed to method 1 above, but the degree of opening is finely adjusted so that the main turbine output may be regulated to a desired value. And, according to this method, even during a transient period when the load varies, the main turbine output can be precisely controlled. According to this method, steam temperature at an outlet of the speed regulating stage would also change corresponding to the variation in the degree of opening of the steam adjusting valve, and therefore, though this method can be hardly said to facilitate a perfect variable-pressure operation, it is a practically useful method.

3. Main steam pressure to speed regulation stage outlet pressure ratio constant control method: In this method the steam adjusting valve is controlled so that a ratio of main steam pressure to a speed regulating stage outlet pressure is maintained constant; and, this method consists of the steam adjusting valve opening constant method described above as method 1 with the addition of a front pressure control capability during a partial transient period. According to this method, a transient variation in the main steam pressure is smaller than is method 1 above, but a transient output change is larger.

Again referring to FIG. 3, at the inlet of the high-pressure turbine 9*a* is a high-pressure bypass valve 25 controlled by a pressure regulator 24, and this valve 25 bypasses main steam to a high-pressure exhaust side of the high pressure turbine 9*a* when the inlet pressure of the high-pressure turbine exceeds a predetermined value. And, the steam exhausting from the high-pressure turbine 9*a* passes through a low-temperature reheated steam pipe check valve 26 and is led to a reheater 27. The steam reheated by this reheater 27 then passes through an intercept valve 28 of the main turbine and is introduced to a medium-pressure turbine 9*b*.

At the inlet of this medium-pressure turbine 9*b* is provided a low-pressure bypass valve 30 controlled by a pressure regulator 29, and this valve 30 bypasses high-temperature reheated steam to a condenser 31 when the inlet pressure of the medium-pressure turbine exceeds a predetermined value. The steam exhausting from the medium-pressure turbine 9*b* passes through a low-pressure turbine 9*c* and is led to a condenser 31, in which the steam is condensed with water. And, the main turbine consisting of the above-described high-pressure turbine 9*a*, medium-pressure turbine 9*b* and low-pressure turbine 9*c*, drives a generator 32.

Furthermore, condensed water flowing out of the condenser 31 passes through a condensed water pump 33, a low-temperature feed water heater 34 and a deaerator 35, and is then fed to a high-pressure feed water heater 2 by the above-mentioned feed water pump 1.

It is to be noted that a plurality of high-pressure and low-pressure feed water heaters 2 and 34 are provided although, in order to simplify the drawings, only one of each is illustrated in FIG. 3. Also, for similar reasons an extraction steam pipe, a main turbine main steam stop valve, a reheated steam stop valve and the like are omitted from the figure. Furthermore, in some cases, the high-pressure bypass valve 25, the low-pressure bypass valve 30 and the low-temperature reheated steam pipe check valve 26 are not always necessary depending upon the desired performance of the system.

Now the advantage obtained in conducting the variable-pressure operation in a supercritical pressure plant will be described.

Figure 4:
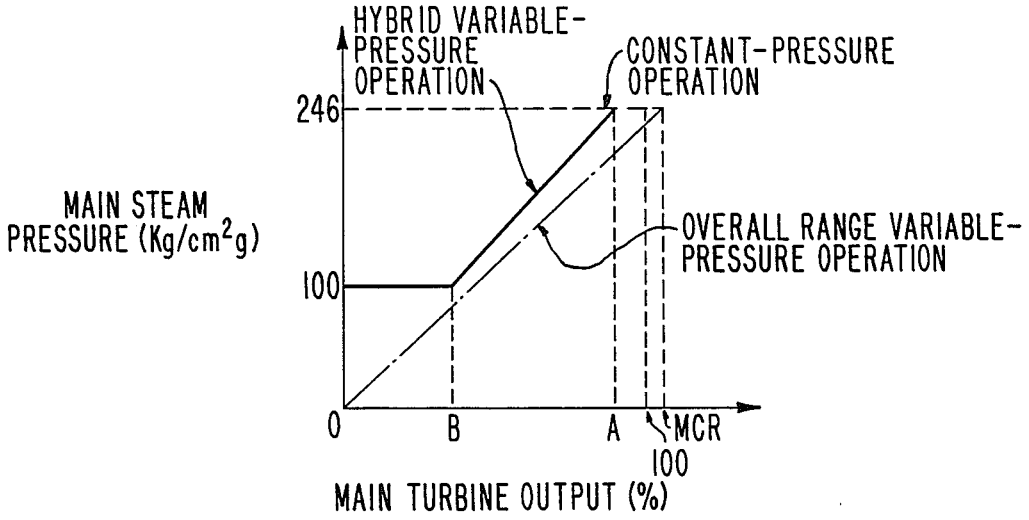
FIG. 4 is a diagram showing one example of a relation between a main turbine output and main steam pressure.

FIG. 4 shows the relationship between main turbine output and main steam pressure.

A solid line in this diagram represents the so-called "hybrid variable-pressure operation" (composite variable-pressure operation) which includes in combination, with respect to the employment of eight steam adjusting valves of a main turbine, valves #1–6 being simultaneously opened and valve #7 and the last valve are sequentially opened, a constant-pressure operation upon the opening of valve #7 and higher loading, and a variable pressure operation in which valves #1–6 are fully open and the load is varied by varying the main steam pressure.

However, under light loading, a steam adjusting valve throttled operation is effected in which main vapor pressure is hedl at about 100 $Kg/cm^2g$ and valves #1–6 are simultaneously opened.

It is to be noted that in FIG. 4, a dash line represents the relationship between the main turbine output and the main steam output when a constant-pressure operation is carried out, while a dash-dot line represents the same relationship when an overall range variable-pressure operation with valves #1–8 fully opened is carried out. In addition, main turbine output A represents an output at a rating main steam pressure with valves #1–6 fully opened and valve #7 fully closed, main turbine output B represents an output at a main steam pressure of 100 $Kg/cm^2g$ with valves #1–6 fully opened and valve #7 fully closed, and a relationship of $B \cong A \times 100/246$ is satisfied. In this figure, MCR is an abbreviation of "Maximum Continuous Rating".

Figure 5:
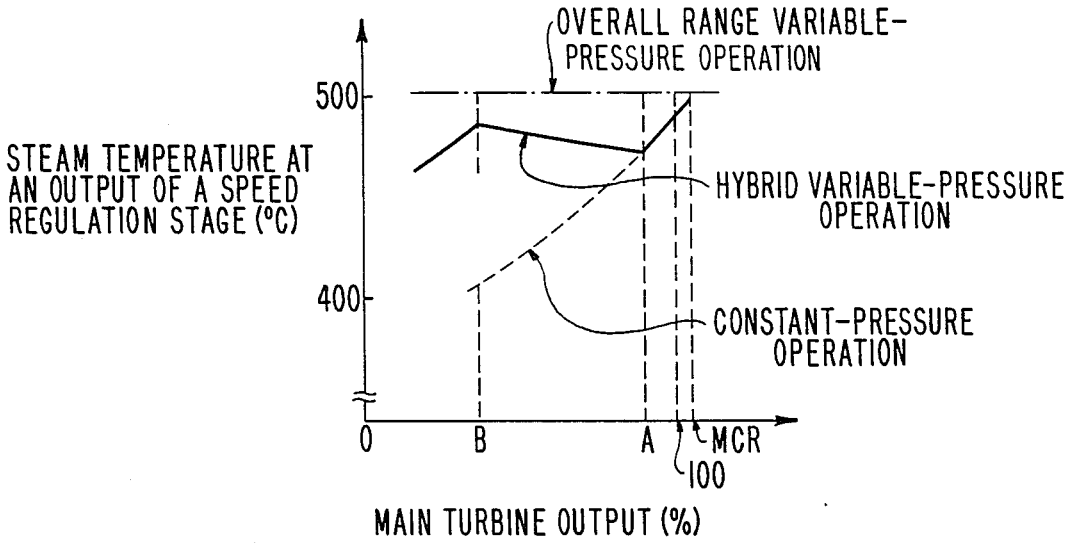
FIG. 5 is a diagram showing one example of a change in the steam temperature at an outlet of a main turbine speed control stage.

FIG. 5 shows a relationship between the main turbine output and the steam temperature at an outlet of a speed regulation stage.

From this figure, it is seen that due to variable-pressure operation, a variation in temperature at an outlet of a speed regulation stage over a range of loads is comparatively small, and thus, thermal stress generated in a turbine rotor is correspondingly small.

Figure 6:
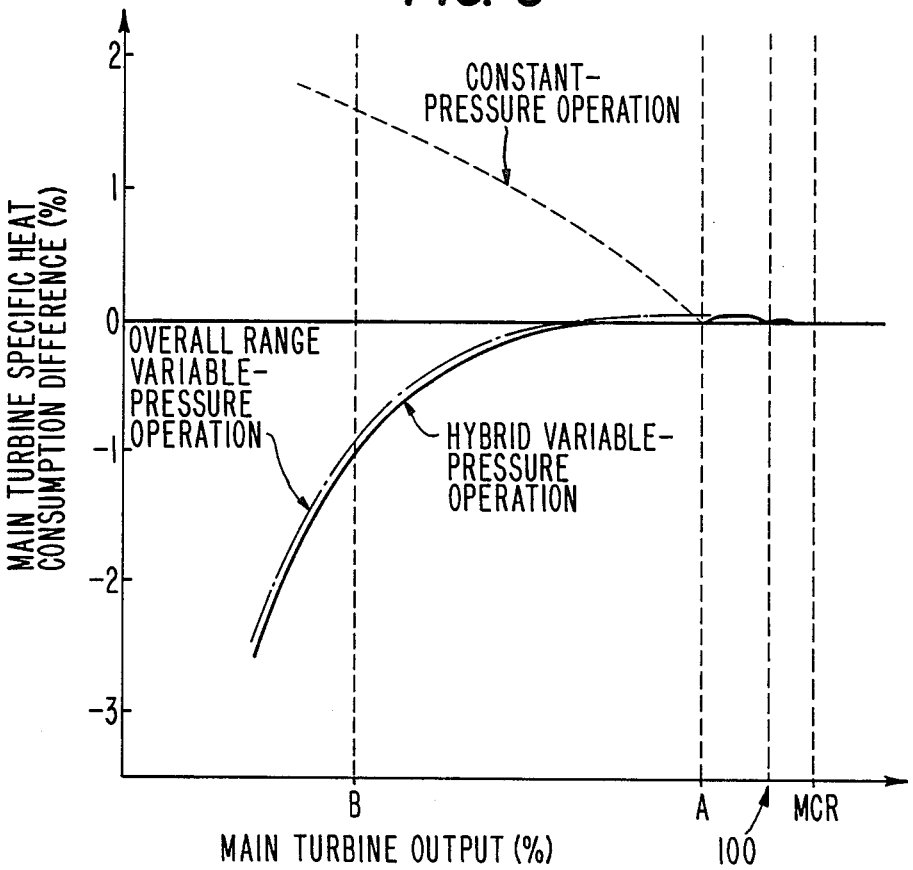
FIG. 6 is a diagram illustrating specific heat consumption of a main turbine.

FIG. 6 shows the specific heat consumption of a main turbine during variable-pressure operation.

As compared to the specific heat consumption of a turbine during nozzle speed regulation type constant-pressure operation and constant-pressure operation effected by the throttling of a steam adjusting valve, improvements in the specific heat consumption in a partial load (especially low load) region by effecting variable-pressure operation can be realized. Due to the fact that under partial loading the generator 13 is driven by the boiler throttle turbine 12 shown in FIG. 4, an output of the entire plant including the output of the main turbine is increased, and therefore, the efficiency of the plant is higher than that shown in FIG. 6.

Figure 8:
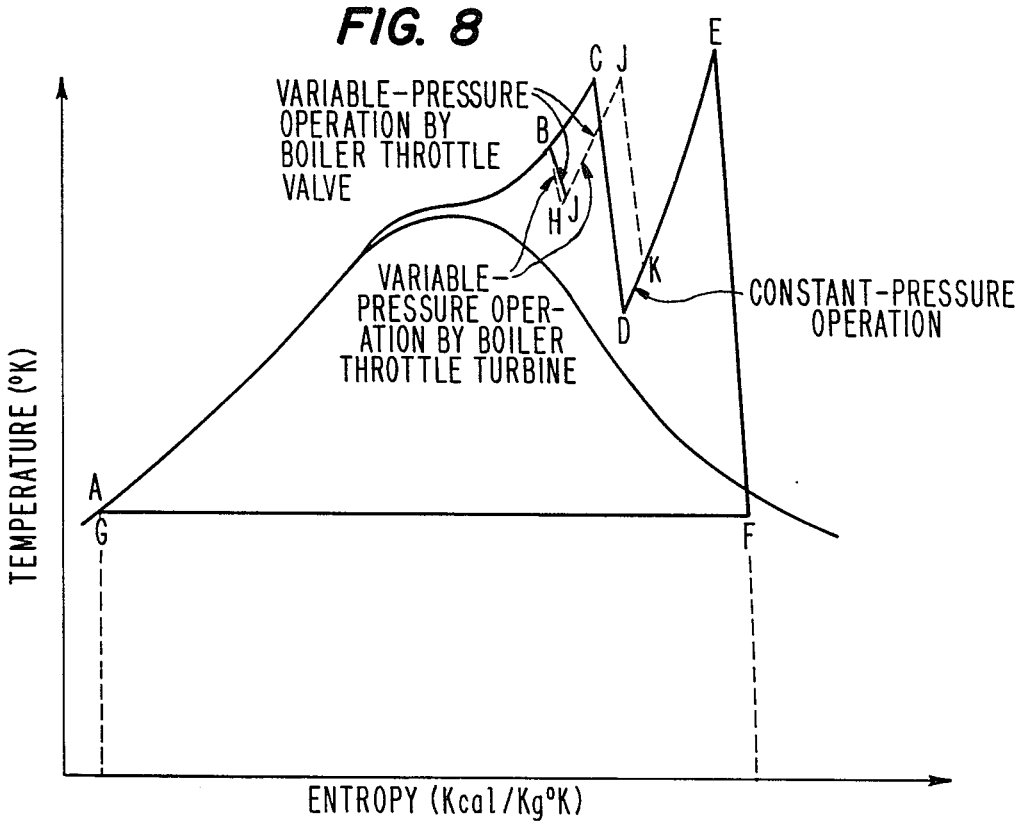
FIGS. 7 and 8, respectively, show an i-S diagram and a T-S diagram of a plant during partial loading.
Figure 7:
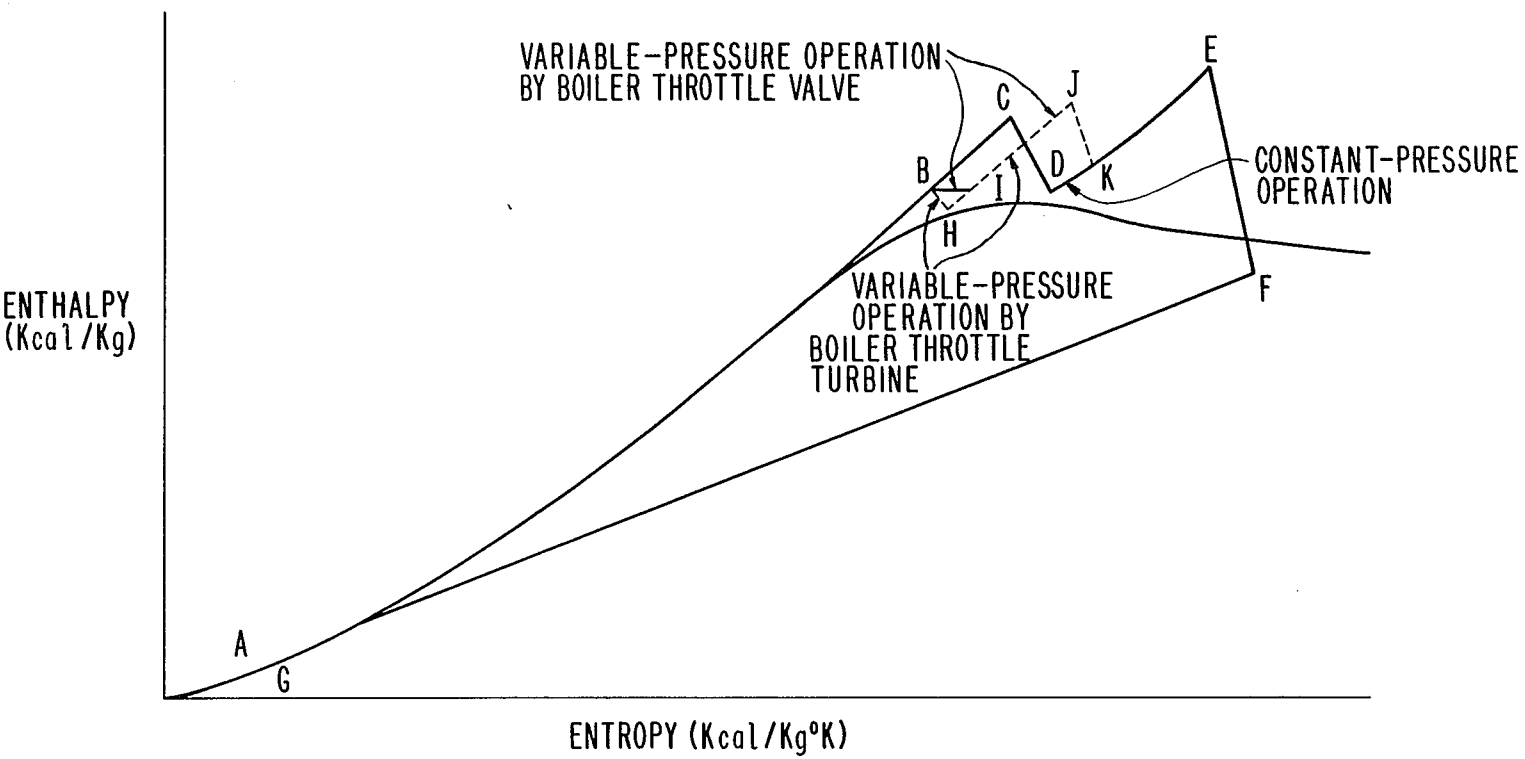

FIGS. 7 and 8, respectively, are an i-S diagram and a T-S diagram of a plant under partial loading.

From these diagrams it is seen that a variable-pressure operation plant employing the boiler throttle turbine acts as a two-stage reheating plant, and so, from a theoretical point of view, a cycle efficiency can be improved according to the present invention.

It is to be noted that in these diagrams A represents the state at the outlet of the feed water pump, B represents the state at the outlet of the primary superheater, C represents the state at the inlet of the high-pressure turbine (constant-pressure operation), D represents the state at the exhaust of the high-pressure turbine (constant-pressure operation), E represents the state at the inlet of the medium-pressure turbine, F represents the state at the exhaust side of the low-ressure turbine, G represents the state of the inlet of the condensed water pump, H represents the state at the exhaust side of the boiler throttle turbine, I represents the state at the outlet of the boiler throttle valve, J represents the state at an inlet of a high-pressure turbine (upon variable-pressure operation), and K represents the state at the exhaust side of the high-pressure turbine (variable-pressure operation). In addition, CD represents work done in the high-pressure turbine, EF represents work done in a medium/low-pressure turbine, BI represents throttling by the boiler throttle valve, and BH represents work done in the boiler throttle turbine.

Figure 9:
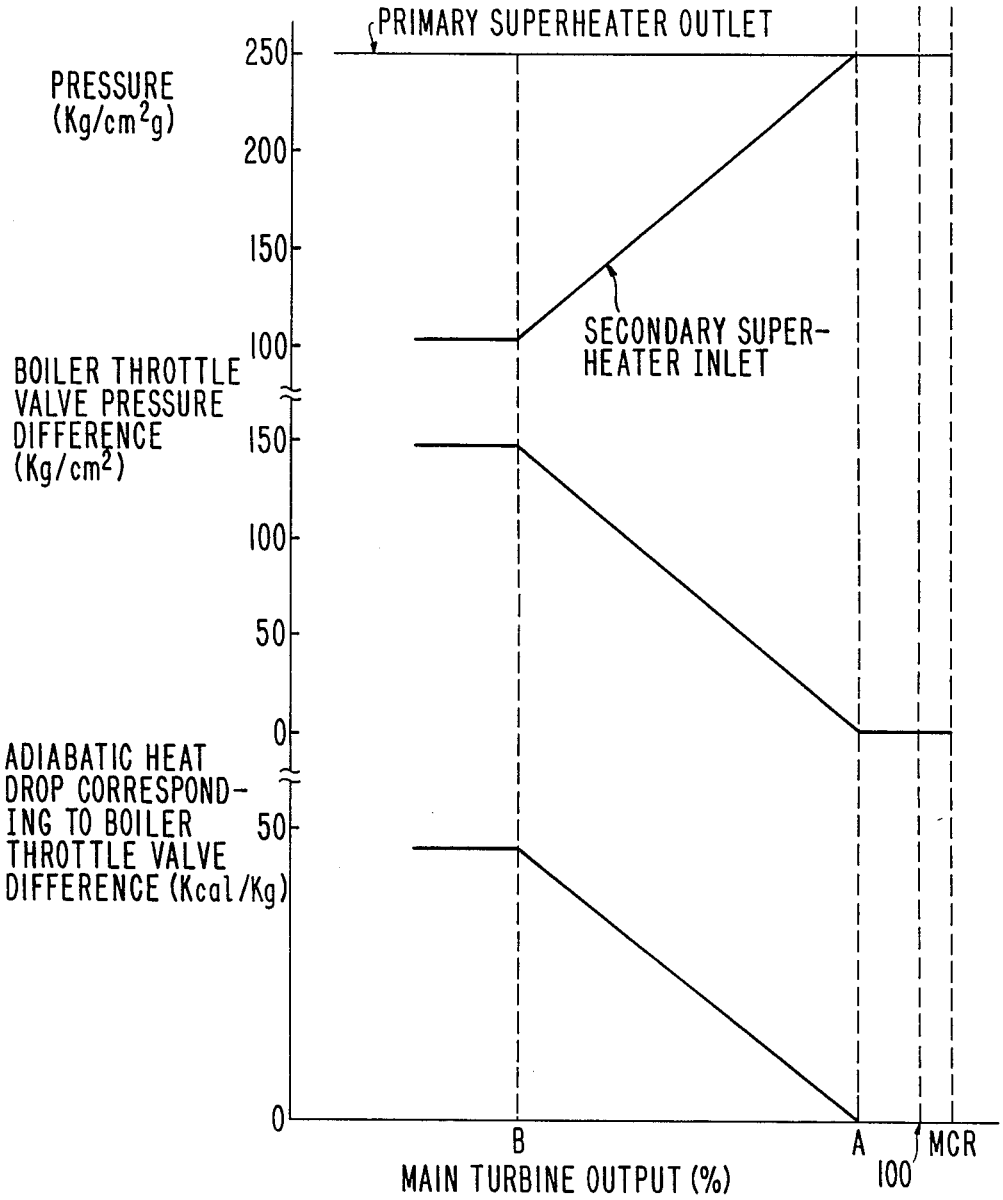
FIG. 9 is a diagram showing a pressure difference across a boiler throttle valve and a corresponding adiabatic heat drop during the variable-pressure operation.

FIG. 9 shows a boiler throttle valve pressure difference and the corresponding adiabatic heat drop when variable-pressure operation is effected in a 1000 MW supercritical pressure plant.

Figure 10:
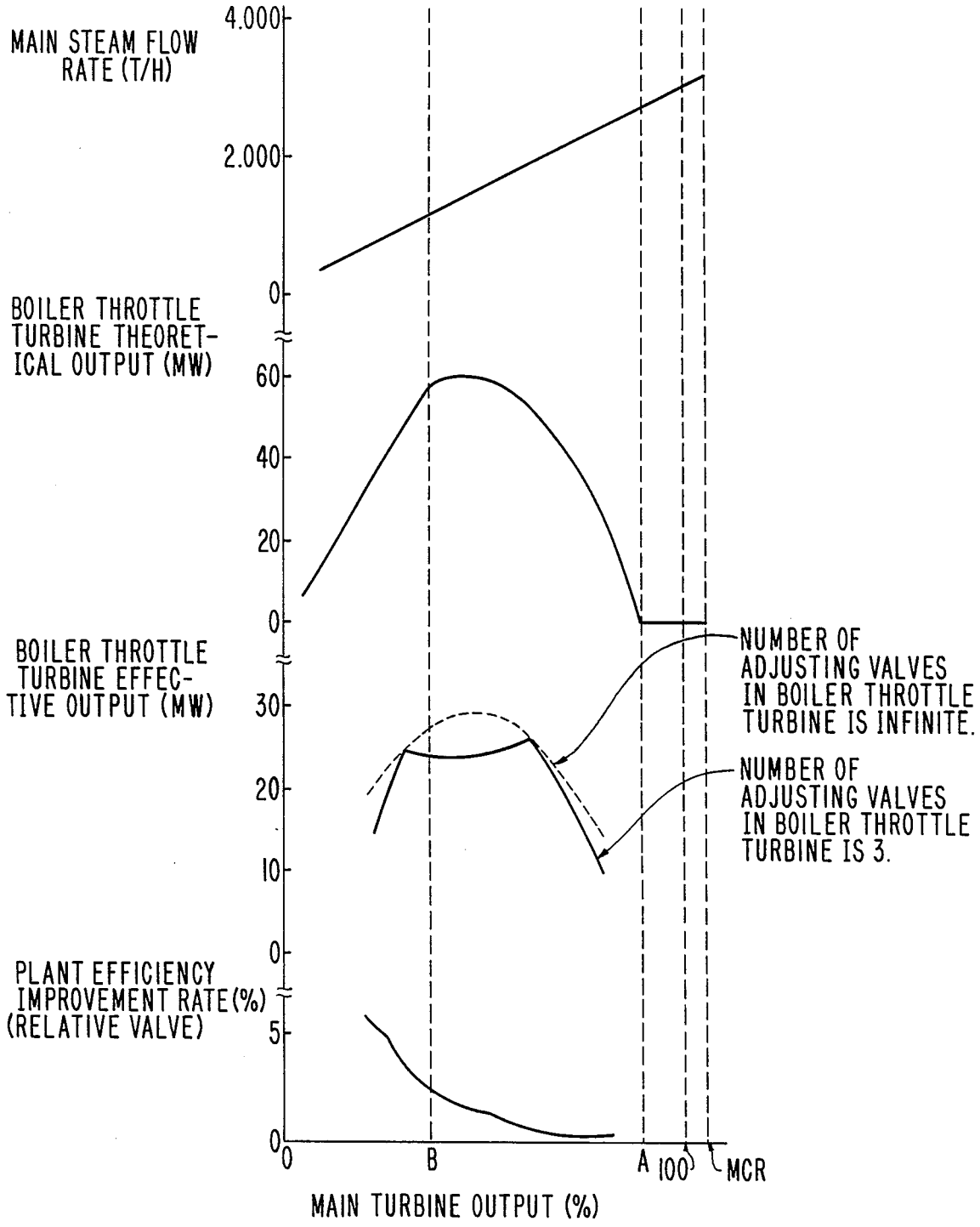
FIG. 10 is a diagram showing an efficiency improvement rate of a variable-pressure operation plant employing a boiler throttle turbine.

And, a theoretical output under the assumption that this adiabatic heat drop is entirely converted into work, and a trial calculation of the effective output when one working example of a boiler throttle turbine according to the present invention is employed, are shown in FIG. 10.

In FIG. 10, a dash line curve represents a theoretical embodiment in which the number of the steam adjusting valves for the boiler throttle turbine is assumed to be infinite, while a solid line curve represents a practical embodiment in which the number of the steam adjusting valves is assumed to be three.

Due to throttling loss of the steam adjusting valve for the boiler throttle valve, the solid line curve is lower than the dash line curve except for valve points (the points where one steam adjusting valve is in a nearly fully opened state, just before the next steam adjusting valve begins to open). However, plant efficiency during partial loading can still be greatly improved as shown in FIG. 10.

In this connection, in FIG. 10, a theoretical output of a boiler throttle turbine is represented by [adiabatic heat drop corresponding to boiler throttle valve pressure difference]33 [main steam flow rate]×[coefficient], and an effective output of a boiler throttle turbine is represented by [theoretical output of boiler throttle turbine]×[efficiency]. In addition, in FIGS. 9 and 10, A and B represent main turbine outputs, respectively, similar to those represented by A and B in FIGS. 4 to 6.

While the present invention has been described above in connection to preferred embodiments thereof, it is intended that the present invention should not be limited only to the illustrated embodiments but many changes and modifications therein can be made without departing from the spirit of the invention.

What is claimed is:

1. A supercritical pressure once-through boiler comprising boiler furnace wall tubes in which boiler water is transformed into steam, a main turbine operatively connected to said boilder furnace wall tubes so as to be driven by the steam, a final superheater operatively connected in the once-through boiler between said boiler furnace wall tubes and said main turbine for superheating the steam produced in the furnace wall tubes before the steam passes to said main turbine, heat recovery means for reducing the pressure of steam by converting the pressure of the steam to mechanical energy and a boiler throttle valve, said heat reovery means and said boiler throttle valve operatively connected in the once-through boiler between said boiler furnace wall tubes and said final superheater.

2. A supercritical pressure once-through boiler as claimed in claim 1, wherein said heat recovery means is a boiler throttle turbine.

3. A supercritical pressure once-through boiler as claimed in claim 7, and further comprising a primary superheater operatively connected in the once-through boiler between said boiler furnace wall tubes and said final superheater, said heat recovery means operatively connected in the once-through boiler between said primary and said final superheaters.

4. A supercritical pressure once-through boiler as claimed in claim 1, and further comprising a primary superheater operatively connected in the once-through boiler between said boiler furnace wall tubes and said final superheater, said heat recovery means operatively connected in the once-through boiler between said boiler furnace wall tubes and said primary superheater.

5. A supercritical pressure once-through boiler as claimed in claim 3, wherein said heat recovery means is a boiler throttle turbine, and further comprising first steam piping connection said primary superheater and said final superheater, said boiler throttle valve operatively disposed in said first steam piping, second steam piping connected in the once-through boiler to said first steam piping at a first location thereon upstream of said boiler throttle valve with respect to the direction of flow of steam therethrough and connected to the inlet of said boiler throttle turbine, a pressure adjusting valve operatively disposed in said second steam piping, a regulator operatively connected to said pressure regulating valve and said second steam piping for detecting the pressure of steam in said second steam piping and for controlling said pressure adjusting valve to open to a degree which maintains the pressure of steam in said second piping at a predetermined valve, and third steam piping connected to said second steam piping at a second location thereon downstream of said boiler throttle valve with respect to the direction of flow of steam therethrough and connected to the outlet of said boiler throttle turbine.

6. A supercritical pressure once-through boiler as claimed in claim 5, and further comprising an auxiliary superheater connected in the once-through boiler between said second location and said final superheater.

* * * * *